US007406730B2

(12) United States Patent
Sundstrom

(10) Patent No.: US 7,406,730 B2
(45) Date of Patent: Aug. 5, 2008

(54) EXAMINATION TABLE

(75) Inventor: Christer Sundstrom, Ingaro (SE)

(73) Assignee: Stille-Sonesta AB, Solna (SE)

( * ) Notice: Subject to any disclaimer, the term of this patent is extended or adjusted under 35 U.S.C. 154(b) by 325 days.

(21) Appl. No.: 11/375,145

(22) Filed: Mar. 15, 2006

(65) Prior Publication Data

US 2006/0220432 A1 Oct. 5, 2006

Related U.S. Application Data

(60) Provisional application No. 60/651,464, filed on Mar. 15, 2005.

(51) Int. Cl.
*A61G 7/015* (2006.01)

(52) U.S. Cl. ..... 5/617; 5/618; 5/86.1; 5/611

(58) Field of Classification Search ..... 5/610, 5/611, 617, 618, 86.1; 297/344.15–344.17, 297/354.13, 362.13
See application file for complete search history.

(56) References Cited

U.S. PATENT DOCUMENTS

| | | | | |
|---|---|---|---|---|
| 3,336,606 | A * | 8/1967 | Beitzel | 5/610 |
| 3,406,772 | A * | 10/1968 | Ahrent et al. | 180/9.23 |
| 4,312,500 | A * | 1/1982 | Janssen | 5/618 |
| 6,336,235 | B1 * | 1/2002 | Ruehl | 5/610 |
| 6,427,263 | B1 * | 8/2002 | Lindell | 5/86.1 |

* cited by examiner

*Primary Examiner*—Michael Trettel
(74) *Attorney, Agent, or Firm*—Dowell & Dowell P.C.

(57) ABSTRACT

An examination and treatment table having a base (1) adapted to lift and lower a table (2) attached thereto, the table comprises a seat cushion (4) and a back cushion (3), which are individually movable. The table (2) is only attached at one side to the base (1) by means of a pivot pin (12) and that the seat cushion (4) and the back cushion (3), respectively, has a suspending frame (29, 30) each connected to the pivot pin (12) and extending along, at least partially, one side of the cushion (3, 4), which is the same side as the pivot pin (12) is provided.

11 Claims, 6 Drawing Sheets

1. Up (seat cushion)
2. Down (seat cushion)
3. Up (table)
4. Down (table)
5. Up (back cushion)
6. Down (back cushion)
7. Reverse Trendelenburg
8. Trendelenburg

EXAMINATION TABLE

CROSS-REFERENCE TO RELATED APPLICATION

This application claims the benefit of U.S. Provisional Patent Application, Ser. No. 60/651,464 filed on Mar. 15, 2005 with the same title and by the same inventor. The entire content of the provisional application is hereby incorporated by reference.

1. Technical Field

The present invention concerns an examination and treatment table having a base adapted to lift and lower a table attached thereto, the table comprises a seat cushion and a back cushion, which are individually movable. The examination table may for example be used for urodynamic and urological examinations and also certain treatments but is of course not limited to these uses.

2. Background Art

Many examination and treatment tables are previously known which are divided into a seat cushion and a back cushion, which are individually movable and which table is liftable. See for example our own WO 96/22758. A major problem with these known tables is that when a patient shall be X-rayed it will always be "shadows" from the different frames for suspending the seat and back cushions and from the base that lifts and lowers the table and also suspends the table.

Another problem with previously known tables is that they move along a curved line, mostly the radius of a lifting arm of the base, when lifted and lowered. Due to this the examination table need more space around it to function properly in all positions.

A further problem is to be able to position the table or at least the back cushion in a substantially vertical position. Previously known tables do not come closer than 15 degrees from the vertical position.

SUMMARY OF THE INVENTION

The object of the present invention is to solve the above-mentioned problems.

According to a first aspect of the present invention an examination and treatment table is provided that is only attached to the lifting and lowering base at one side of the table by means of a pivot pin. The seat cushion and the back cushion, respectively, has a suspending frame each connected to the pivot pin and extending, at least partially, along one side of the cushion, which is the same side as the pivot pin is provided.

This gives the advantage that the table is fully accessible for X-rays without any "shadows" due to frame or base parts or the like underneath the table since the only disturbing frames are positioned along one side of the table and the same is true for the pivot pin which also is provided at the side of the table. Usually a C-arm X-ray apparatus is used and with the present invention it will be easy to set it and use it in all desired positions.

According to a second aspect of the present invention an examination and treatment table is provided which is liftable and lowerable substantially vertically so that the examination table will require less space around it. This is achieved by means of a base comprising two parallelogram link systems. The first parallelogram is attached with its first end to a floor frame and the second end to the first end of the second parallelogram. The second parallelogram is attached with its first end to the first parallelogram and its second end to the table via the pivot pin. Another advantage is that a higher level of the table above the ground is achievable than before.

According to a third aspect of the present invention the table or at least the back cushion is movable to a vertical position by means of a seat motor and a back motor controlling the rotation of the seat cushion and the back cushion around the pivot pin.

According to a fourth aspect of the present invention it is possible to have a left suspended table or a right suspended table by attaching the base to the left side of the floor frame or to the right side of the floor frame and turn the floor frame 180 degrees.

According to a fifth aspect of the present invention the seat cushion and the back cushion are jointly movable retaining a mutual angular position. This is preferably achieved by means of making the motors for each cushion to work parallel, i.e. jointly, so that the two cushions move simultaneously. The motors are preferably controlled by a control switch, which comprises suitably connected relays.

SHORT DESCRIPTION OF THE DRAWINGS

The present invention will now be described in more detail under referral to the enclosed drawings, in which FIG. 1 shows a view of a preferred embodiment of an examination and treatment table of the present invention shown from the side having a pivot pin.

DETAILED DESCRIPTION OF PREFERRED EMBODIMENTS

Figure 1:
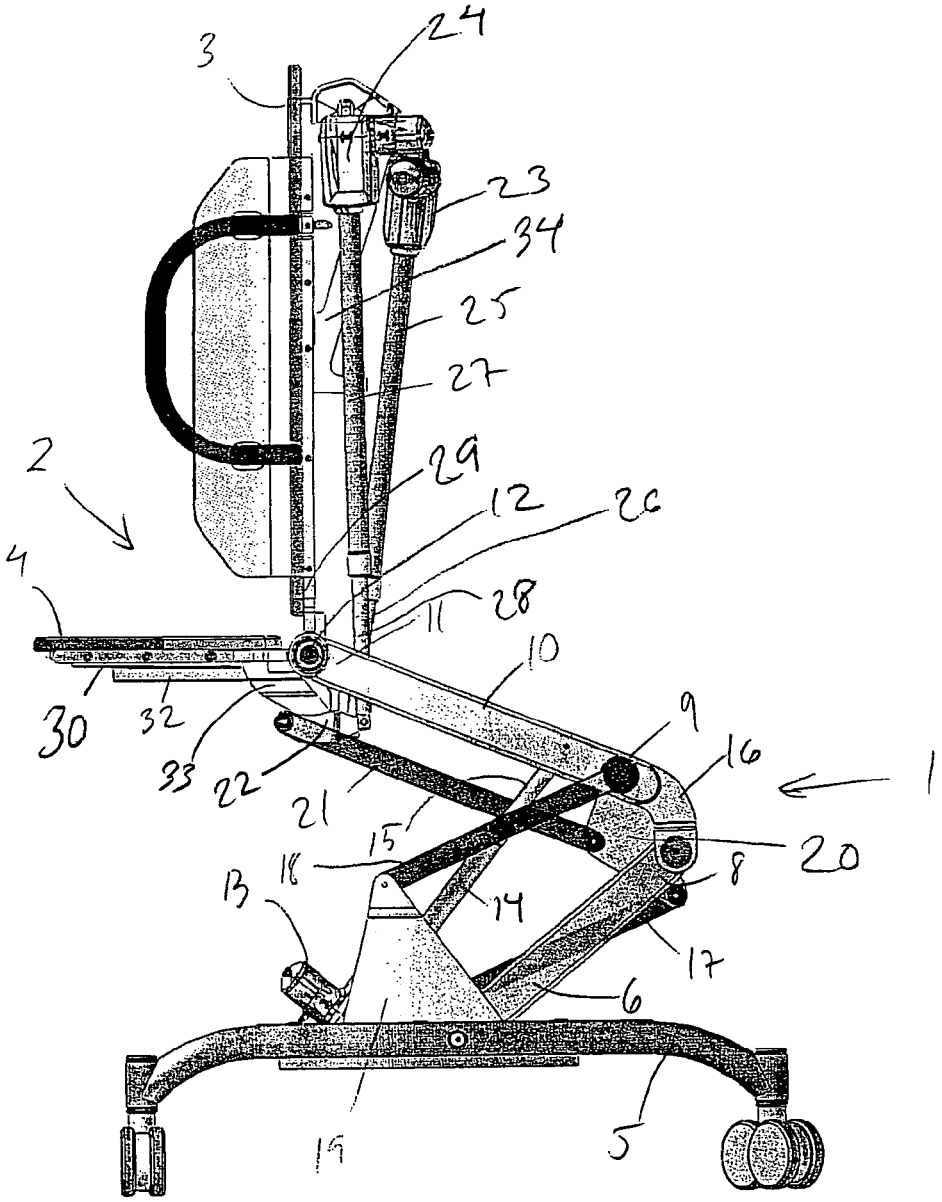
Figure 2:
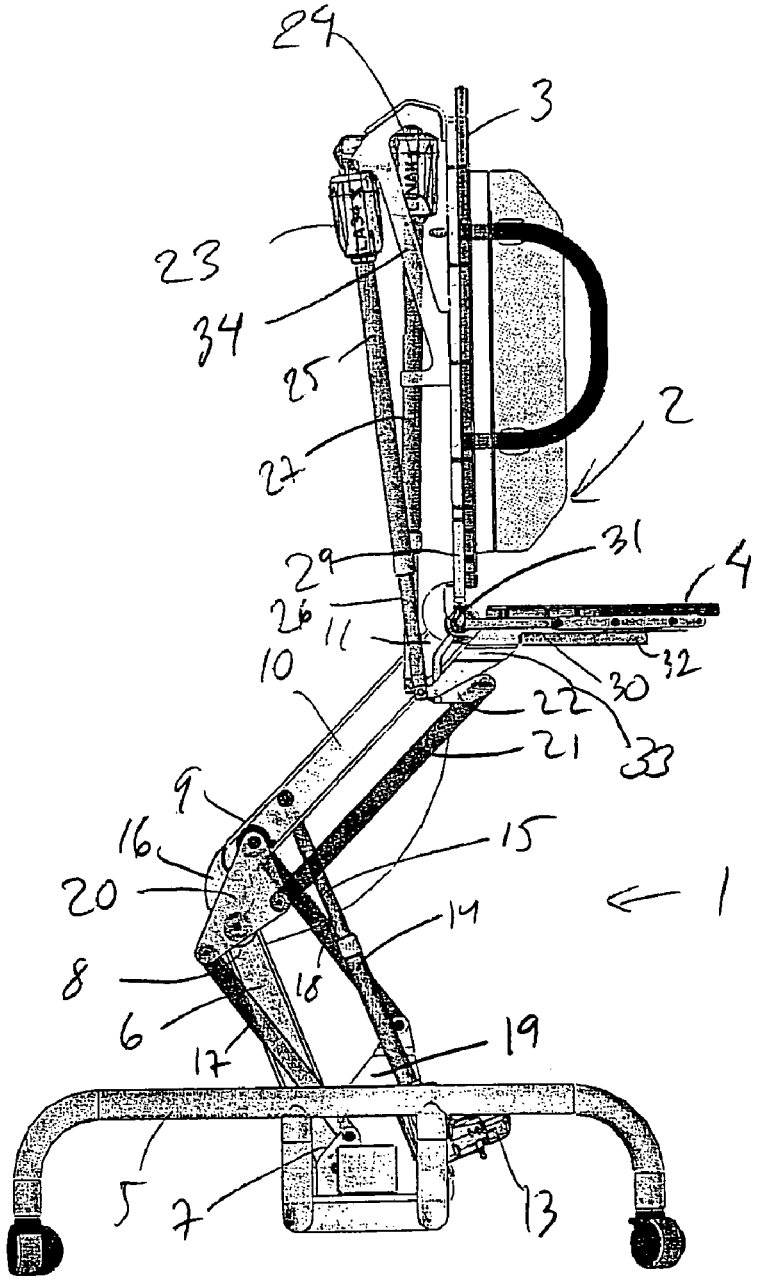
FIG. 2 shows the examination and treatment table of FIG. 1 from the opposite side.

FIGS. 1 and 2 shows an examination and treatment table of a preferred embodiment of the present invention, which comprises in its basic design a preferably easily movable base 1 which carries a back cushion 3 and a seat cushion 4 making up a table 2, besides ordinary arm, leg and foot supports and other accessories.

The base 1 comprises a floor frame 5, which carries a lower arm 6 that is pivotally connected thereto at a first end 7 thereof and which is pivotally connected at its second end 8 to a first end 9 of an upper arm 10. A second end 11 of the upper arm 10 is pivotally connected to a pivot pin 12 at the table 2. Therefore, the table 2 with its cushions 3, 4 may be lifted and lowered by a movement of the pivotally journalled arms 6, 10. In the shown embodiment, a middle portion 16 is arranged in between the lower and upper arms, 6 and 10.

A lifting and lowering motor 13, for example of the shifting type, having a cylinder 14 and an extendable rod 15, is arranged at the floor frame 5 and the outer end of the extendable rod 15 connected to the upper arm 10 in order to push or retract the extendable rod 15 so that the table 2 will be lifted or lowered.

In order to control the lifting and lowering of the table 2 to a substantially vertical movement the base 1 comprises a linkage system, too. A first parallelogram link system is pivotally connected to the floor frame 5 via a lower bracket 19 at a first end of the first parallelogram link system. A second end of the first parallelogram link system is pivotally connected to a second parallelogram link system at its first end thereof. A second end of the second parallelogram link system is pivotally connected to the table 2.

In more detail the first parallelogram link system comprises a lower rod 17 and an upper rod 18 which are pivotally connected at the first end to the floor frame 5 via the lower bracket 19. A second end of the lower rod 17 is pivotally connected to a middle bracket 20. A second end of the upper rod 18 is also pivotally connected to a middle bracket 20 but at another position. It is also pivotally connected, at the same axis, to the first end 9 of the upper arm 10.

The second parallelogram link system comprises a lower rod 21 and the upper arm 10, both pivotally connected to the middle bracket 20 at their first ends. A second end of the arm 10 is directly pivotally connected to the table 2 at the pivot pin 12. A second end of the lower rod 21 is pivotally connected to an upper bracket 22. The upper bracket 22 is fixedly connected to the pivot pin 12.

The pivot pin 12 is arranged at one side of the table 2 at the division making up the seat cushion 4 and the back cushion 3. Both the cushions 3, 4 has a frame 29, 30 each extending along at least partially one side of each cushion 3, 4. The frames 29, 30 are arranged on the same side as the pivot pin 12 and pivotally connected thereto. The seat and the back cushions 4, 3 may for example be made of carbon fibre laminated boards and provided with cushion material on top to make it comfortable for the patient.

If desired a hinge 31 may be provided between the seat cushion 4 and the back cushion 3 on the opposite side to the pivot pin 12 in order to further stabilize the table 2. At the free end of the seat cushion 4 at the sides thereof fastening brackets 32 for foot rests may be provided. These brackets 32 and the hinge 31 might cause some shadows when X-raying although no vital parts of the patient's body will be shadowed.

The seat cushion 4 and the back cushion 3 may be swung individually in order to adjust their inclination in relation to the horizontal plane. Simplified, the cushions 3, 4 may be described, in one position, as forming a horizontal table, whereas they, in another position, may be described as forming a chair. The angular positions of the cushions 3, 4 are infinitely variable and the adjustment of the cushions 3, 4 are controlled by a seat motor 23 and a back motor 24, for example of the same type as the base motor 13. The seat motor 23 has a cylinder 25 and an extendable rod 26 and the back motor 24 has a cylinder 27 and an extendable rod 28.

The seat cushion 4 is provided with a swing bracket 33 extending backwards, downwards from the seat frame 30. At the free end of the swing bracket 33 the outer end of the extendable rod 26 of the seat motor 23 is pivotally connected in order to swing the seat cushion 4 around the pivot pin 12. The seat motor 23 is connected at a motor bracket 34 arranged at the back frame 29, i.e. at the side of the back cushion 3.

The back motor 24 is also connected at the motor bracket 34. The outer end of the extendable rod 28 of the back motor 24 is pivotally connected to the upper bracket 22 of the second parallelogram link system, which upper bracket is fixedly connected to the pivot pin 12. Thus extending or retracting of the extendable rod 28 makes the back cushion 3 to rotate around the pivot pin 12.

The back cushion 3 may also be rotated backwards beyond a horizontal position, into a so called shock position or Trendelenburgh position, wherein the patient, resting on his back, has his head situated in a lower position than his body.

The examination table according to the invention has been designed in such a manner that the two cushions 3, 4 are jointly movable while retaining their mutual angular position. This is achieved by running both the seat motor 23 and the back motor 24 at the same time, i.e. in parallel.

Figure 3:
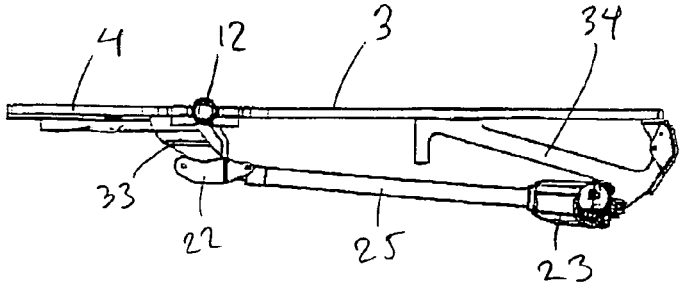
FIG. 3 shows the table in a horizontal position with the seat motor.
Figure 4:
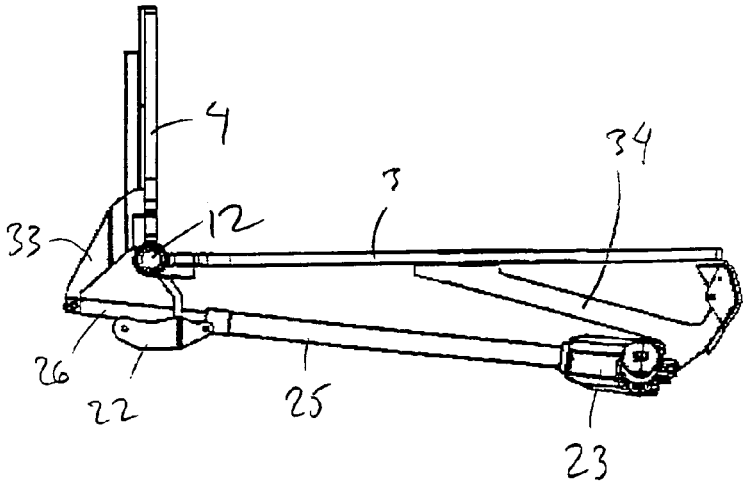
FIG. 4 shows the table in a seat up and horizontal back position with the seat motor.
Figure 5:
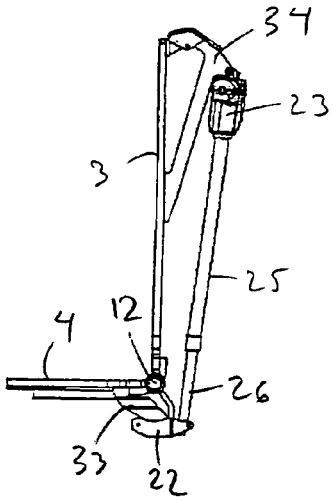
FIG. 5 shows the table in a chair position with the seat motor.
Figure 6:
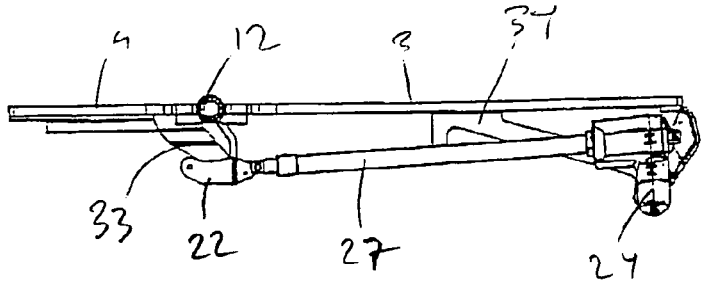
FIG. 6 shows the table in a horizontal position with the back motor.
Figure 7:
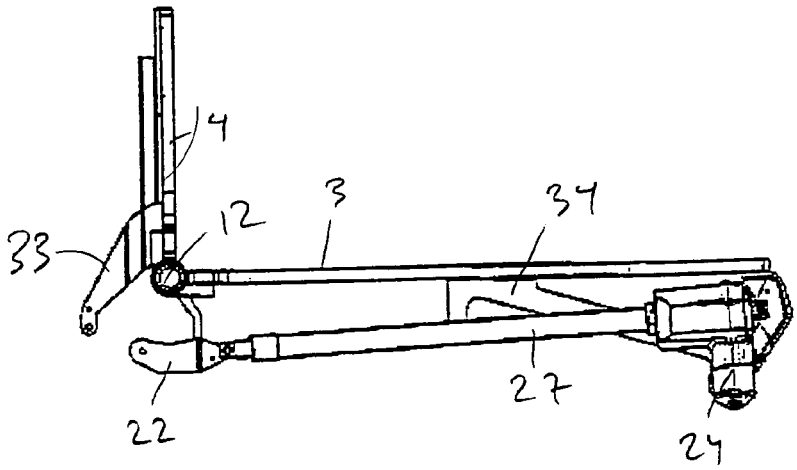
FIG. 7 shows the table in a seat up and horizontal back position with the back motor.
Figure 8:
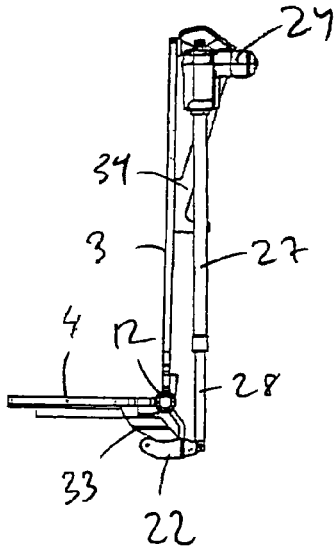
FIG. 8 shows the table in a chair position with the back motor.
Figure 9:
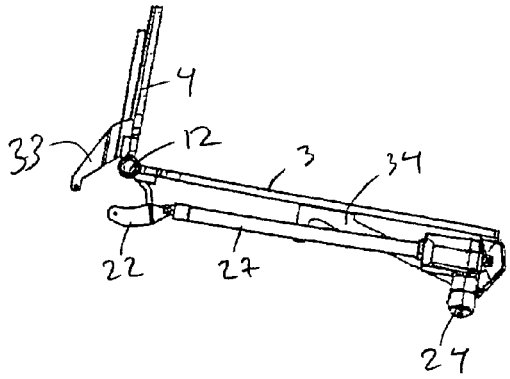
FIG. 9 shows the table as a chair in a trendelenburgh position with the back motor.

In order to clarify the functionalities and positions of the back and seat cushions 3, 4 and their corresponding motors 24, 23 FIGS. 3-5 shows how the seat motor 23, 25, 26 is connected and positioned in three different table positions, namely horizontal, horizontal back and seat up, and horizontal seat and upright back, respectively.

FIGS. 6-9 shows how the back motor 24, 27, 28 is connected and positioned in four different table positions, namely horizontal, horizontal back and seat up, horizontal seat and upright back, and trendelenburgh position with seat up, respectively.

Figure 10:
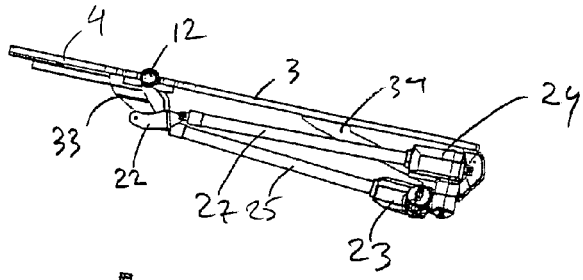
FIG. 10 shows the table in a flat trendelenburgh position with the seat and the back motor.
Figure 11:
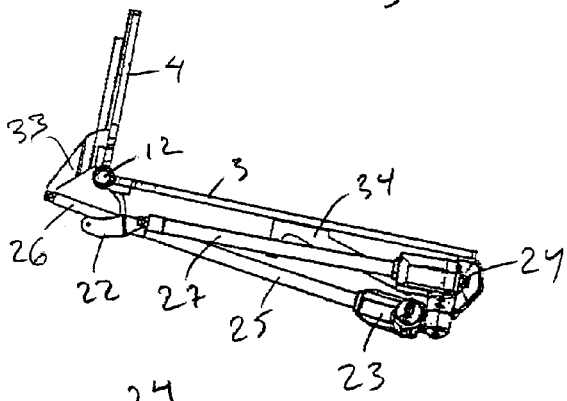
FIG. 11 shows the table as a chair in a trendelenburgh position with the seat and the back motor.
Figure 12:
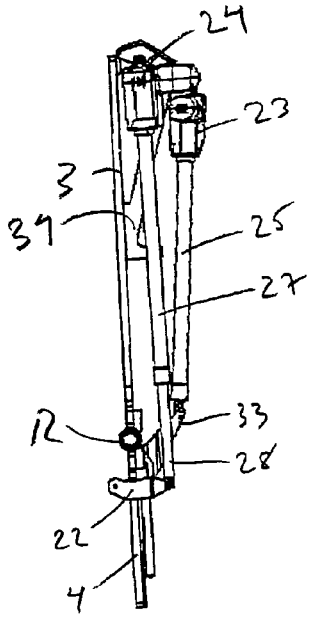
FIG. 12 shows the table in a flat vertical position with the seat and the back motor.

Finally, FIGS. 10-12 shows how both the seat motor 23, 25, 26 and the back motor 24, 27, 28 is connected and positioned in three different table positions, namely flat trendelenburgh position, trendelenburgh position with seat up, and vertical position, respectively.

Figure 13:
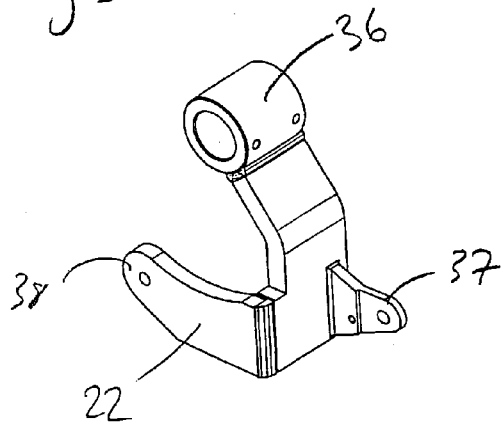
FIG. 13 shows an upper bracket arranged at the pivot pin.

FIG. 13 shows the upper bracket 22, which is fixedly connected to the pivot pin 12 at the sleeve 36. An ear 37 is attached to the extendable rod 28 of the back motor 24. The free end 38 of the bracket is attached to the lower rod 21 of the upper parallelogram link system.

Figure 14:
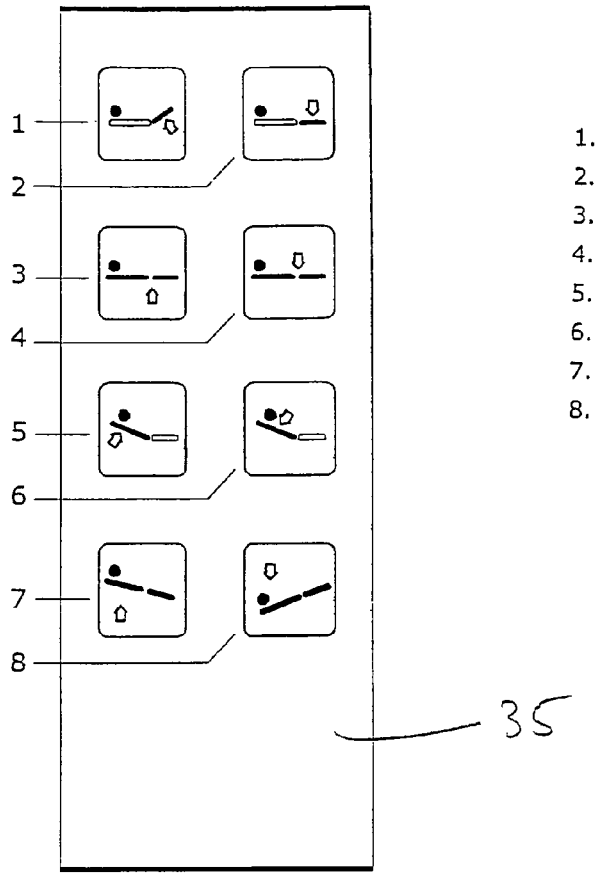
FIG. 14 shows a switch control that controls at least the seat and back motors.

A switch control 35 controls at least the seat and back motors 23, 24 and preferably also the base motor 13 as in the shown embodiment in FIG. 14. The switch control comprises relays coupled in a desired way to control the different motors 13, 23 and 24.

A function of the present invention is the possibility to lock the interposition of the seat cushion 4 and the back cushion 3 and jointly rotate them around the pivot pin 12 retaining a mutual angular position. This is achieved by using the $7^{th}$ and $8^{th}$ button on the switch control.

Figure 15:
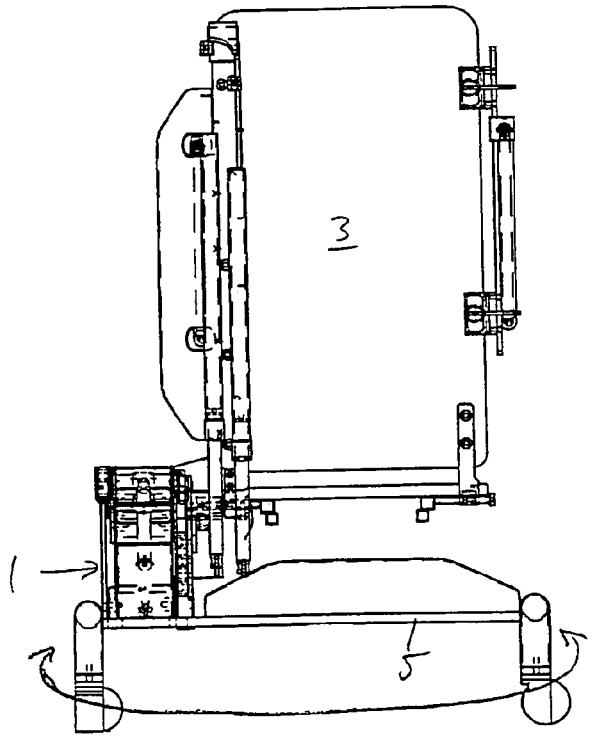
FIG. 15 shows a floor frame rotating relative to the table.

In smaller rooms it may not always be possible to position an examination and treatment table of the present invention in any position and it may be useful to have either a left suspended embodiment or a right suspended embodiment. An easy way to solve this problem instead of having to produce mirror image embodiments is make it possible to rotate the floor frame 5 in relation to the rest of the examination table. See FIG. 15.

In this way the base 1 may be attached at either side of the floor frame 5 and turned 180 degrees in the case the table will not be positioned above the floor frame 5. It may be possible also to mount the base 1 at a slide (not shown) arranged on the floor frame 5 so that the base 1 will be easy to move from one side to the other.

The invention claimed is:

1. An examination and treatment table having a base (1) adapted to lift and lower a table (2) attached thereto, the table (2) comprising a seat cushion (4) and a back cushion (3), which are individually movable, wherein the table (2) is only attached at one side to the base (1) by means of a pivot pin (12) and the seat cushion (4) and the back cushion (3), respectively, has a suspending frame (29,30) each connected to the pivot pin (12) and extending along, at least partially, one side of the cushion (3,4), which is the same side that the pivot pin (12) is provided.

2. The examination and treatment table of claim 1, wherein the seat cushion (4) and the back cushion (3) are moveable together to retain a mutual angular position relative to each other.

3. The examination and treatment table of claim 1, wherein the base (1) includes a first parallelogram link system attached at its first end to a floor frame (5) and a second parallelogram link system attached at its first end to the first parallelogram link system at its second end and at the second end of the second parallelogram link system to the pivot pin (12) in order to be able to lift and lower the table (2) substantially vertically.

4. The examination and treatment table of claim 3, wherein the seat cushion (4) is movable by means of a seat motor (23) attached between a swing bracket (33) on the seat cushion (4) and a motor bracket (34) on the back cushion (3), and the back cushion (3) is movable by means of a back motor (24) attached between the motor bracket (34) on the back cushion (3) and the second end of the second parallelogram link system, whereby at least the back cushion (3) is movable to a vertical position and preferably also the seat cushion (4).

5. The examination and treatment table of claim 4, wherein the seat and back motors (23, 24) are controlled by means of a switch control in order to stop and start each motor (23, 24).

6. The examination and treatment table of claim 5, wherein the switch control includes relays working as to make the seat motor (23) and back motor (24) to work jointly in order to move the seat cushion (4) and back cushion (3) jointly, retaining their mutual angular positions when desired.

7. The examination and treatment table of claim 3, wherein the first parallelogram link system is attached to the floor frame (5) at a first side in order to have the table (2) suspended at the side or on the opposite side of the floor frame (5) and turn the floor frame 180 degrees in order to have the table (2) suspended at the opposite side.

8. The examination and treatment table of claim 2, wherein the base (1) includes a first parallelogram link system attached at its first end to a floor frame (5) and a second parallelogram link system attached at its first end to the first parallelogram link system at its second end and at the second end of the second parallelogram link system to the pivot pin (12) in order to be able to lift and lower the table (2) substantially vertically.

9. The examination and treatment table of claim 4, wherein the first parallelogram link system is attached to the floor frame (5) at a first side in order to have the table (2) suspended at the side or on the opposite side of the floor frame (5) and turn the floor frame 180 degrees in order to have the table (2) suspended at the opposite side.

10. The examination and treatment table of claim 5, wherein the first parallelogram link system is attached to the floor frame (5) at a first side in order to have the table (2) suspended at the side or on the opposite side of the floor frame (5) and turn the floor frame 180 degrees in order to have the table (2) suspended at the opposite side.

11. The examination and treatment table of claim 6, wherein the first parallelogram link system is attached to the floor frame (5) at a first side in order to have the table (2) suspended at the side or on the opposite side of the floor frame (5) and turn the floor frame 180 degrees in order to have the table (2) suspended at the opposite side.

* * * * *